US007266975B2

(12) United States Patent
Hupkes et al.

(10) Patent No.: US 7,266,975 B2
(45) Date of Patent: Sep. 11, 2007

(54) PROCESS OF LIQUEFYING A GASEOUS, METHANE-RICH FEED TO OBTAIN LIQUEFIED NATURAL GAS

(75) Inventors: Willem Hupkes, deceased, late of Rijnsburg (NL); by Arina Petronella Jacoba Hupkes-Van Der Toorn, legal representative, Rijnsburg (NL); Pei Jung Lin, Kaohsiung (TW); Roland Pierre Silve, Sur (OM); Kornelis Jan Vink, Sur (OM)

(73) Assignee: Shell Oil Company, Houston, TX (US)

( * ) Notice: Subject to any disclaimer, the term of this patent is extended or adjusted under 35 U.S.C. 154(b) by 300 days.

(21) Appl. No.: 10/766,072

(22) Filed: Jan. 28, 2004

(65) Prior Publication Data

US 2004/0255615 A1 Dec. 23, 2004

(30) Foreign Application Priority Data

Jan. 31, 2003 (EP) ..... 03250608

(51) Int. Cl.
*F25J 1/00* (2006.01)

(52) U.S. Cl. ..... 62/612

(58) Field of Classification Search ..... 62/611, 62/612, 149

See application file for complete search history.

(56) References Cited

U.S. PATENT DOCUMENTS 3,668,882 A * 6/1972 Sarsten et al. ..... 62/77
3,742,721 A 7/1973 Bourguet et al. ..... 62/37
3,889,485 A * 6/1975 Swearingen ..... 62/48.2
4,755,200 A 7/1988 Liu et al. ..... 62/11
4,809,154 A * 2/1989 Newton ..... 700/28
4,901,533 A * 2/1990 Fan et al. ..... 62/614
5,139,548 A * 8/1992 Liu et al. ..... 62/611
5,486,995 A 1/1996 Krist et al. ..... 364/149
5,611,216 A * 3/1997 Low et al. ..... 62/612
5,651,269 A 7/1997 Prevost et al. ..... 62/613
5,651,270 A 7/1997 Low et al. ..... 62/613
5,791,160 A * 8/1998 Mandler et al. ..... 62/611
5,893,274 A 4/1999 Nagelvoort et al. ..... 62/613
6,158,240 A * 12/2000 Low et al. ..... 62/611
6,272,882 B1 8/2001 Hodges et al. ..... 62/613
6,722,157 B1 * 4/2004 Eaton et al. ..... 62/612
6,725,688 B2 * 4/2004 Elion et al. ..... 62/612
6,789,394 B2 * 9/2004 Elion et al. ..... 62/612

FOREIGN PATENT DOCUMENTS

EP 252455 1/1988
EP 0529307 A1 7/1992

(Continued)

OTHER PUBLICATIONS

European Search Report of Jun. 23, 2003.

(Continued)

*Primary Examiner*—William C. Doerrier

(57) ABSTRACT

A process of liquefying a gaseous, methane-rich feed to a liquefied product is provided that includes adjusting the composition and the amount of refrigerant and controlling the liquefaction process using an advanced process controller based on model predictive control to determine simultaneous control actions for a set of manipulated variables.

68 Claims, 1 Drawing Sheet

FOREIGN PATENT DOCUMENTS

| | | | |
|---|---|---|---|
| EP | 701186 | | 3/1996 |
| SU | 1458663 | A1 | 2/1989 |
| WO | WO99/31448 | | 6/1999 |
| WO | WO 01/81845 | A1 | 11/2001 |

OTHER PUBLICATIONS

Perry's Chemical Engineer's Handbook, 7th Edition, pp. 8-25 to 8-27.

International Application No. PCT/EP2004/050055, filed Jan. 30, 2004, with International Search Report.

Written Opinion of the International Searching Authority for International Application No. PCT/EP2004/050055.

International Preliminary Report on Patentability for International Application No. PCT/EP2004/050055.

* cited by examiner

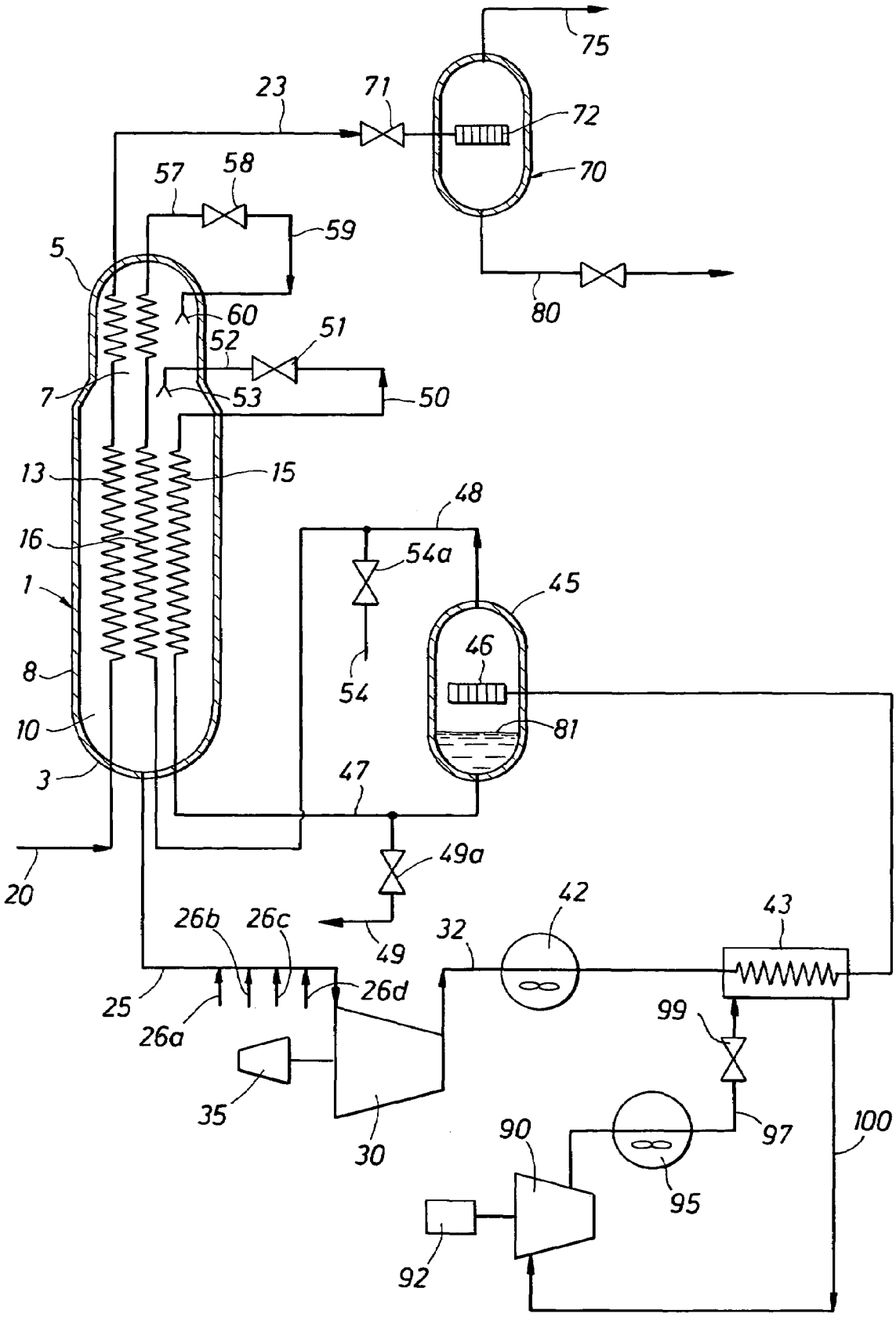
75
23
71
72
70
57
58
59
5
60
52
51
80
7
53
50
13
15
48
16
54a
1
45
46
8
54
10
81
3
47
20
49a
42
43
26b
26c
32
49
25
26d
99
26a
35
97
100
30
90
95
92

PROCESS OF LIQUEFYING A GASEOUS, METHANE-RICH FEED TO OBTAIN LIQUEFIED NATURAL GAS

The present invention relates to a process of liquefying a gaseous, methane-rich feed to obtain a liquefied product. The liquefied product is commonly called liquefied natural gas. In particular the present invention relates to controlling the liquefaction process.

The liquefaction process includes the steps of:

(a) supplying the gaseous, methane-rich feed at elevated pressure to a first tube side of a main heat exchanger at its warm end, cooling, liquefying and sub-cooling the gaseous, methane-rich feed against evaporating refrigerant to get a liquefied stream, removing the liquefied stream from the main heat exchanger at its cold end and passing the liquefied stream to storage as liquefied product;

(b) removing evaporated refrigerant from the shell side of the main heat exchanger at its warm end;

(c) compressing in at least one refrigerant compressor the evaporated refrigerant to get high-pressure refrigerant;

(d) partly condensing the high-pressure refrigerant and separating in a separator the partly-condensed refrigerant into a liquid heavy refrigerant fraction and a gaseous light refrigerant fraction;

(e) sub-cooling the heavy refrigerant fraction in a second tube side of the main heat exchanger to get a sub-cooled heavy refrigerant stream, introducing the heavy refrigerant stream at reduced pressure into the shell side of the main heat exchanger at its mid-point, and allowing the heavy refrigerant stream to evaporate in the shell side; and (f) cooling, liquefying and sub-cooling at least part of the light refrigerant fraction in a third tube side of the main heat exchanger to get a sub-cooled light refrigerant stream, introducing the light refrigerant stream at reduced pressure into the shell side of the main heat exchanger at its cold end, and allowing the light refrigerant stream to evaporate in the shell side.

International patent application publication No. 99/31 448 discloses controlling a liquefaction process by an advanced process controller based on model predictive control to determine simultaneous control actions for a set of manipulated variables in order to optimize at least one of a set of parameters whilst controlling at least one of a set of controlled variables. The set of manipulated variables includes the mass flow rate of the heavy refrigerant fraction, the mass flow rate of the light refrigerant fraction and the mass flow rate of the methane-rich feed. The set of controlled variables includes the temperature difference at the warm end of the main heat exchanger and the temperature difference at the mid-point of the main heat exchanger. The set of variables to be optimized includes the production of liquefied product. The process was considered to be advantageous because the bulk composition of the mixed refrigerant was not manipulated to optimize the production of liquefied product. However, Applicant had now found that separately controlling the bulk composition of the mixed refrigerant is cumbersome.

SUMMARY OF THE INVENTION

Thus, it is desirable to provide an alternative process, that include control of the bulk composition of the mixed refrigerant. A process of liquefying a gaseous, methane-rich feed is provided, said liquefaction process comprising:

(a) providing the gaseous, methane-rich feed at elevated pressure to a first tube side of a main heat exchanger at its warm end, cooling, liquefying and sub-cooling the gaseous, methane-rich feed against evaporating refrigerant to get a liquefied stream, removing the liquefied stream from the main heat exchanger at its cold end and passing the liquefied stream to storage as liquefied product;

(b) removing evaporated refrigerant from the shell side of the main heat exchanger at its warm end;

(c) compressing in at least one refrigerant compressor the evaporated refrigerant to get high-pressure refrigerant;

(d) at least partly condensing the high-pressure refrigerant and separating in a separator the partly-condensed refrigerant into a liquid heavy refrigerant fraction and a gaseous light refrigerant fraction;

(e) sub-cooling the heavy refrigerant fraction in a second tube side of the main heat exchanger to get a sub-cooled heavy refrigerant stream, introducing the heavy refrigerant stream at reduced pressure into the shell side of the main heat exchanger at its mid-point, and allowing the heavy refrigerant stream to evaporate in the shell side; and (f) cooling, liquefying and sub-cooling at least part of the light refrigerant fraction in a third tube side of the main heat exchanger to get a sub-cooled light refrigerant stream, introducing the light refrigerant stream at reduced pressure into the shell side of the main heat exchanger at its cold end, and allowing the light refrigerant stream to evaporate in the shell side, the process further comprising adjusting the composition and the amount of refrigerant and controlling the liquefaction process, using an advanced process controller based on model predictive control to determine simultaneous control actions for a set of manipulated variables in order to optimize at least one of a set of parameters whilst controlling at least one of a set of controlled variables, wherein the set of manipulated variables includes the mass flow rate of the heavy refrigerant fraction, the mass flow rate of the light refrigerant fraction, the amount of refrigerant components make-up, the amount of refrigerant removed, the capacity of the refrigerant compressor and the mass flow rate of the methane-rich feed, wherein the set of controlled variables includes the temperature difference at the warm end of the main heat exchanger, a variable relating to the temperature of the liquefied natural gas, the composition of the refrigerant entering the separator of step (d), the pressure in the shell of the main heat exchanger, the pressure in the separator of step (d) and the level of the liquid in the separator of step (d), and wherein the set of variables to be optimized includes the production of liquefied product.

BRIEF DESCRIPTION OF THE DRAWING

The FIGURE is a schematic process flow diagram of one embodiment of the invention.

DETAILED DESCRIPTION OF THE INVENTION

The process of liquefying a gaseous, methane-rich feed of the invention to obtain a liquefied product can further comprise adjusting the composition and the amount of refrigerant and controlling the liquefaction process, using an advanced process controller based on model predictive control to determine simultaneous control actions for a set of manipulated variables in order to optimize at least one of a set of parameters whilst controlling at least one of a set of controlled variables, wherein the set of manipulated variables includes the mass flow rate of the heavy refrigerant fraction, the mass flow rate of the light refrigerant fraction, the amount of refrigerant components make-up, the amount of refrigerant removed, the capacity of the refrigerant compressor and the mass flow rate of the methane-rich feed, wherein the set of controlled variables includes the temperature difference at the warm end of the main heat exchanger, a variable relating to the temperature of the liquefied natural gas, the composition of the refrigerant entering the separator of step (d), the pressure in the shell of the main heat exchanger, the pressure in the separator of step (d) and the level of the liquid in the separator of step (d), and wherein the set of variables to be optimized includes the production of liquefied product.

In the specification and in the claims the term 'manipulated variable' is used to refer to variables that can be manipulated by the advanced process controller, and the term 'controlled variables' is used to refer to variables that have to be kept by the advanced process controller at a predetermined value (set point) or within a predetermined range (set range). The expression 'optimizing a variable' is used to refer to maximizing or minimizing the variable and to maintaining the variable at a predetermined value.

Model predictive control or model based predictive control is a well-known technique, see for example Perry's Chemical Engineers' Handbook, 7th Edition, pages 8-25 to 8-27. A key feature of model predictive control is that future process behaviour is predicted using a model and available measurements of the controlled variables. The controller outputs are calculated so as to optimize a performance index, which is a linear or quadratic function of the predicted errors and calculated future control moves. At each sampling instant, the control calculations are repeated and the predictions updated based on current measurements. A suitable model is one that comprises a set of empirical step-response models expressing the effects of a step-response of a manipulated variable on the controlled variables.

An optimum value for the parameter to be optimized can be obtained from a separate optimization step, or the variable to be optimized can be included in the performance function.

Before model predictive control can be applied, one determines first the effect of step changes of the manipulated variables on the variable to be optimized and on the controlled variables. This results in a set of step-response coefficients. This set of step-response coefficients forms the basis of the model predictive control of the liquefaction process.

During normal operation, the predicted values of the controlled variables are regularly calculated for a number of future control moves. For these future control moves a performance index is calculated. The performance index includes two terms, a first term representing the sum over the future control moves of the predicted error for each control move and a second term representing the sum over the future control moves of the change in the manipulated variables for each control move. For each controlled variable, the predicted error is the difference between the predicted value of the controlled variable and a reference value of the controlled variable. The predicted errors are multiplied with a weighting factor, and the changes in the manipulated variables for a control move are multiplied with a move suppression factor. The performance index discussed here is linear.

Alternatively, the terms may be a sum of squared terms, in which case the performance index is quadratic.

Moreover, constraints can be set on manipulated variables, change in manipulated variables and on controlled variables. This results in a separate set of equations that are solved simultaneously with the minimization of the performance index.

Optimization can be done in two ways; one way is to optimize separately, outside the minimization of the performance index, and the second way is to optimize within the performance index.

When optimization is done separately, the variables to be optimized are included as controlled variables in the predicted error for each control move and the optimization gives a reference value for the controlled variables.

Alternatively, optimization is done within the calculation of the performance index, and this gives a third term in the performance index with an appropriate weighting factor. In this case, the reference values of the controlled variables are pre-determined steady state values, which remain constant.

The performance index is minimized taking into account the constraints to give the values of the manipulated variables for the future control moves. However, only the next control move is executed. Then the calculation of the performance index for future control moves starts again.

The models with the step response coefficients and the equations required in model predictive control are part of a computer program that is executed in order to control the liquefaction process. A computer program loaded with such a program that can handle model predictive control is called an advanced process controller. Because the computer programs are commercially available, we will not discuss such programs in detail. The present invention is more directed to selecting the variables.

Process of liquefying a gaseous, methane-rich feed (20) to obtain a liquefied product (23), is provided comprising:

(a) supplying the feed (10) (20) at elevated pressure to a first tube side (13) of a main heat exchanger (1) at its warm end (3), liquefying the feed against evaporating refrigerant to get a liquefied stream (23), removing the liquefied stream (23) from the main heat exchanger (1) at its cold end (5) and passing the liquefied stream (23) to storage as liquefied product;

(b) removing evaporated refrigerant (25) from the shell side (10) of the main heat exchanger (1);

(c) compressing in at least one refrigerant compressor (30) the evaporated refrigerant to get high-pressure refrigerant (32);

(d) partly condensing (42, 43) the high-pressure refrigerant (32) and separating in a separator (45) the partly-condensed refrigerant into a liquid heavy refrigerant fraction (47) and a gaseous light refrigerant fraction (48);

(e) sub-cooling the heavy refrigerant fraction in a second tube side (15), introducing the heavy refrigerant stream (52) at reduced pressure into the shell side (10) of the main heat exchanger (1) at its mid-point (7), and allowing the heavy refrigerant stream to evaporate in the shell side (10); and (f) cooling, liquefying and sub-cooling at least part of the light refrigerant fraction (48) in a third tube side (16) to get a sub-cooled light refrigerant stream, introducing the light refrigerant stream (57) at reduced pressure into the shell side (10), and allowing the light refrigerant stream to evaporate, the process further comprises adjusting the composition and the amount of refrigerant and controlling the liquefaction process, using an advanced process controller based on model predictive control to determine simultaneous control actions for a set of manipulated variables in order to optimize at least one of a set of parameters whilst controlling at least one of a set of controlled variables, wherein the set of manipulated variables includes the mass flow rate of the heavy refrigerant fraction, the mass flow rate of the light refrigerant fraction, the amount of refrigerant components make-up, the amount of refrigerant removed, the capacity of the refrigerant compressor and the mass flow rate of the methane-rich feed, wherein the set of controlled variables includes the temperature difference at the warm end (3) of the main heat exchanger (1), a variable relating to the temperature of the liquefied natural gas, the composition of the refrigerant entering the separator (45), the pressure in the shell of the main heat exchanger, the pressure in the separator (45) and the level of the liquid in the separator (45), and wherein the set of variables to be optimized includes the production of liquefied product.

The invention will now be described by way of example with reference to the accompanying drawing showing schematically a flow scheme of a plant for liquefying natural gas.

The plant for liquefying natural gas comprises a main heat exchanger 1 with a warm end 3, a cold end 5 and a mid-point 7. The wall 8 of the main heat exchanger 1 defines a shell side 10. In the shell side 10 are located a first tube side 13 extending from the warm end 3 to the cold end 5, a second tube side 15 extending from the warm end 3 to the mid-point 7 and a third tube side 16 extending from the warm end 3 to the cold end 5.

During normal operation, a gaseous, methane-rich feed is supplied at elevated pressure through supply conduit 20 to the first tube side 13 of the main heat exchanger 1 at its warm end 3. The feed, which passes through the first tube side 13, is cooled, liquefied and sub-cooled against refrigerant evaporating in the shell side 10. The resulting liquefied stream is removed from the main heat exchanger 1 at its cold end 5 through conduit 23. The liquefied stream is passed to storage (not shown) where it is stored as liquefied product at atmospheric pressure.

Evaporated refrigerant is removed from the shell side 10 of the main heat exchanger 1 at its warm end 3 through conduit 25. To adjust the bulk composition of the refrigerant, components, such as nitrogen, methane, ethane and propane can be added to the refrigerant in conduit 25 through conduits 26*a*, 26*b*, 26*c* and 26*d*. The conduits 26*a* through *d* are provided with suitable valves (not shown) controlling the flow of the components into the conduit 25. The refrigerant is also called mixed refrigerant or multicomponent refrigerant.

In a refrigerant compressor 30, the evaporated refrigerant is compressed to get high-pressure refrigerant that is removed through conduit 32. The refrigerant compressor 30 is driven by a suitable motor, for example a gas turbine 35, which is provided with a starter-helper motor (not shown).

Refrigerant at high pressure in conduit 32 is cooled in air cooler 42 and partly condensed in heat exchanger 43 to obtain partly-condensed refrigerant. The air cooler 42 can be replaced by a heat exchanger in which refrigerant is cooled against seawater.

The high-pressure refrigerant is introduced into a separator in the form of separator vessel 45 through inlet device 46. In the separator vessel 45, the partly-condensed refrigerant is separated into a liquid heavy refrigerant fraction and a gaseous light refrigerant fraction. The liquid heavy refrigerant fraction is removed from the bottom of the separator vessel 45 through conduit 47, and the gaseous light refrigerant fraction is removed through conduit 48.

To adjust the amount of refrigerant, heavy refrigerant can be drained through conduit 49 provided with valve 49*a*.

The heavy refrigerant fraction is sub-cooled in the second tube side 15 of the main heat exchanger 1 to get a sub-cooled heavy refrigerant stream. The sub-cooled heavy refrigerant stream is removed from the main heat exchanger 1 through conduit 50, and allowed to expand over an expansion device in the form of an expansion valve 51. At reduced pressure it is introduced through conduit 52 and nozzle 53 into the shell side 10 of the main heat exchanger 1 at its mid-point 7. The heavy refrigerant stream is allowed to evaporate in the shell side 10 at reduced pressure, thereby cooling the fluids in the tube sides 13, 15 and 16.

To adjust the amount of refrigerant, gaseous light refrigerant can be vented through conduit 54 provided with valve 54*a*.

The gaseous light refrigerant fraction removed through conduit 48 is passed to the third tube side 16 in the main heat exchanger 1 where it is cooled, liquefied and sub-cooled to get a sub-cooled light refrigerant stream. The sub-cooled light refrigerant stream is removed from the main heat exchanger 1 through conduit 57, and allowed to expand over an expansion device in the form of an expansion valve 58. At reduced pressure it is introduced through conduit 59 and nozzle 60 into the shell side 10 of the main heat exchanger 1 at its cold end 5. The light refrigerant stream is allowed to evaporate in the shell side 10 at reduced pressure, thereby cooling the fluids in the tube sides 13, 15 and 16.

The resulting liquefied stream is removed from the main heat exchanger 1 through the conduit 23 and passed to flash vessel 70. The conduit 23 is provided with an expansion device in the form of an expansion valve 71 in order to allow reduction of the pressure, so that the resulting liquefied stream is introduced via inlet device 72 in the flash vessel 70 at a reduced pressure. The reduced pressure is suitably substantially equal to atmospheric pressure. Expansion valve 71 also regulates the total flow.

From the top of the flash vessel 70 an off-gas is removed through conduit 75. The off-gas can be compressed in an end-flash compressor (not shown) to get high-pressure fuel gas.

From the bottom of the flash vessel 70 liquefied product is removed through conduit 80 and passed to storage (not shown).

A first objective is to maximize production of liquefied product flowing through conduit 80, which is manipulated by expansion valve 71.

To achieve this objective the liquefaction process is controlled using an advanced process controller based on model predictive control to determine simultaneous control actions for a set of manipulated variables in order to optimize the production of liquefied product whilst controlling at least one of a set of controlled variables.

The set of manipulated variables includes the mass flow rate of the heavy refrigerant fraction flowing through conduit 52 (expansion valve 51), the mass flow rate of the light refrigerant fraction flowing through conduit 57 (expansion valve 58), the amount of refrigerant components make-up (supplied through conduits 26*a* through *d*), the amount of refrigerant removed by bleeding through conduit 49 and/or venting through conduit 54, the capacity of the refrigerant compressor 30 and the mass flow rate of the methane-rich feed through conduit 20 (which is manipulated by expansion valve 71). In an alternative embodiment an expansion turbine (not shown) can be arranged in conduit 23, upstream of the expansion valve 71.

Of these manipulated variables, the mass flow rate of the heavy refrigerant fraction, the mass flow rate of the light refrigerant fraction, the amount of refrigerant components make-up, and the amount of refrigerant removed by bleeding and/or venting are manipulated variables that relate to the inventory or amount of the mixed refrigerant.

The capacity of the refrigerant compressor 30 (or compressors if more than one refrigerant compressor is used) is determined by the speed of the refrigerant compressor, the angle of the inlet guide vane of the refrigerant compressor, or both the speed of the refrigerant compressor and the angle of the inlet guide vane. Thus, the manipulated variable capacity of the refrigerant compressor is the speed of the refrigerant compressor, the angle of the inlet guide vane of the refrigerant compressor, or both the speed of the refrigerant compressor and the angle of the inlet guide vane.

The set of controlled variables includes the temperature difference at the warm end 3 of the main heat exchanger 1 (which is the difference between the temperature of the fluid in conduit 20 and the temperature in conduit 25).

Suitably an additional variable is controlled, which is the temperature difference at the mid point 7, which is the difference between the temperature of the gas being liquefied in the first tube side 13 at the midpoint 7 and the temperature of the fluid in the shell side 10 of the main heat exchanger 1 at the mid point 7. In the specification and the claims, this temperature difference will be referred to as the first mid point temperature difference.

Suitably an additional variable is controlled, which is the temperature difference at the mid point 7, which is the difference between the temperature of the gas being liquefied in the first tube side 13 at the midpoint 7 and the temperature of the heavy mixed refrigerant stream introduced through conduit 52. In the specification and the claims, this temperature difference will be referred to as the second mid point temperature difference.

Suitably a further controlled variable is the temperature of the gas being liquefied in the first tube side 13 at the midpoint 7.

The set of controlled variables also includes a variable relating to the temperature of the liquefied natural gas. Moreover the set of controlled variables includes the composition of the refrigerant entering the separator vessel 45, the pressure in the shell 10 of the main heat exchanger 1, the pressure in the separator vessel 45, and the level 81 of the liquid in the separator vessel 45.

The set of variables to be optimized includes the production of liquefied product.

By selecting these variables, control of the main heat exchanger 1 with advanced process control based on model predictive control is achieved.

Applicant had found that thus an efficient and rapid control can be achieved that allows optimizing the production of liquefied product, controlling the temperature profile in the main heat exchanger and controlling the refrigerant composition and amount or inventory of the refrigerant.

Essential for the present invention is the insight that the composition and the inventory of the mixed refrigerant cannot be separated from optimizing the production of liquefied product.

One of the controlled variables is the temperature difference at the warm end 3 of the main heat exchanger 1, which is the difference between the temperature of the fluid in conduit 20 and the temperature in conduit 25. The temperature of the warm end 3 is kept between predetermined limits (a minimum limit value and a limit maximum value) in order to ensure that no liquid refrigerant is withdrawn from the shell side 10 through conduit 25.

Suitably an additional variable is controlled, which is the temperature difference at the mid point 7, which is the difference between the temperature of the gas being liquefied in the first tube side 13 at the midpoint 7 and the temperature of the fluid in the shell side 10 of the main heat exchanger 1 at the mid point 7. This first mid point temperature difference should remain in a predetermined range.

Suitably an additional variable is controlled, which is the temperature difference at the mid point 7, which is the difference between the temperature of the gas being liquefied in the first tube side 13 at the midpoint 7 and the temperature of the heavy mixed refrigerant stream introduced through conduit 53. This second mid point temperature difference should remain in a predetermined range.

Suitably a further controlled variable is the temperature of the gas being liquefied in the first tube side 13 at the midpoint 7, and this temperature should be kept below a predetermined value.

One of the controlled variables is the variable relating to the temperature of the liquefied natural gas. Suitably, this is the temperature of the liquefied natural gas removed from the main heat exchanger 1 through conduit 23. Alternatively the variable relating to the temperature of the liquefied natural gas is the amount of off-gas flowing through conduit 75.

Suitably, the set of variables to be optimized includes, in addition to the production of liquefied product, the nitrogen content of the refrigerant and the propane content of the refrigerant, wherein the nitrogen content is minimized and the propane content is maximized.

As stated in the introduction, optimization can be done separately or it can be done in the calculation of the performance index. In the latter case, the variables to be optimized are weighted with a predetermined weighting factor. Both methods allow the operator to select to maximize the production or to optimize the refrigerant composition.

A further objective of the present invention is to maximize the utilization of the compressors. To this end the production of liquefied natural gas is maximized until a compressor constraint is reached. Therefore the set of controlled variables further includes the power required to drive the refrigerant compressor 30, or refrigerant compressors if more than one refrigerant compressor is used.

Additionally, the speed of the refrigerant compressor(s) is a controlled variable, in that it can be reduced until the maximum value of the temperature difference at the warm end 3 reaches the maximum limit value.

In heat exchanger 43 high pressure refrigerant is partly condensed. In this heat exchanger, and some others (not shown), heat is removed by means of indirect heat exchange with an auxiliary refrigerant (for example propane) evaporating at a suitable pressure in the shell side of the heat exchanger(s).

Evaporated auxiliary refrigerant is compressed in an auxiliary compressor 90 driven by a suitable motor, such as a gas turbine 92. Auxiliary refrigerant is condensed in air cooler 95, wherein air is the external coolant. Condensed auxiliary refrigerant at elevated pressure is passed through conduit 97 provided with expansion valve 99 to the shell side of heat exchanger 43. The condensed auxiliary refrigerant is allowed to evaporate at low pressure and evaporated auxiliary refrigerant is returned through conduit 100 to the auxiliary compressor 92. It will be understood that more than one auxiliary compressor can be employed, arranged in parallel or in series.

The air cooler 95 can be replaced by a heat exchanger in which refrigerant is cooled against seawater.

In order to integrate the control of the cycle of the auxiliary refrigerant with the control of the main heat exchanger 1, the set of manipulated variables further includes the capacity of the auxiliary refrigerant compressor 90 or compressors, and the set of controlled variables further includes the power to drive the auxiliary refrigerant compressor 90 or compressors. In this way the utilization of the propane compressor can be maximized.

The capacity of the auxiliary refrigerant compressor 90 (or compressors if more than one auxiliary refrigerant compressor is used) is determined by the speed of the auxiliary refrigerant compressor, the angle of the inlet guide vane of the auxiliary refrigerant compressor, or both the speed of the refrigerant compressor and the angle of the inlet guide vane. Thus, the manipulated variable capacity of the auxiliary refrigerant compressor is the speed of the auxiliary refrigerant compressor, the angle of the inlet guide vane of the auxiliary refrigerant compressor, or both the speed of the refrigerant compressor and the angle of the inlet guide vane.

In the embodiment shown in the FIGURE, heavy refrigerant can be drained through conduit 49 provided with valve 49*a*, and gaseous light refrigerant can be vented through conduit 54 provided with valve 54*a*. Alternatively, mixed refrigerant can be removed from conduit 32, downstream of the refrigerant compressor 30. In this way the amount of refrigerant can be adjusted as well.

We claim:

1. A process of liquefying a gaseous, methane-rich feed to a liquefied product, said liquefaction process comprising the steps of:

(a) providing the gaseous, methane-rich feed at elevated pressure to a first tube side of a main heat exchanger at its warm end, cooling, liquefying and sub-cooling the gaseous, methane-rich feed against evaporating refrigerant to get a liquefied steam, removing the liquefied stream from the main heat exchanger at its cold end and passing the liquefied stream to storage as liquefied product;

(b) removing evaporated refrigerant from the shell side of the main heat exchanger at its warm end;

(c) compressing in at least one refrigerant compressor the evaporated refrigerant to get high-pressure refrigerant;

(d) at least partly condensing the high-pressure refrigerant and separating in a separator the partly-condensed refrigerant into a liquid heavy refrigerant fraction and a gaseous light refrigerant fraction;

(e) sub-cooling the heavy refrigerant fraction in a second tube side of the main heat exchanger to get a sub-cooled heavy refrigerant stream, introducing the heavy refrigerant stream at reduced pressure into the shell side of the main heat exchanger at its mid-point, and allowing the heavy refrigerant stream to evaporate in the shell side; and (f) cooling, liquefying and sub-cooling at least part of the light refrigerant fraction in a third tube side of the main heat exchanger to get a sub-cooled light refrigerant stream, introducing the light refrigerant stream at reduced pressure into the shell side of the main heat exchanger at its cold end, and allowing the light refrigerant stream to evaporate in the shell side, the process further comprising adjusting the composition and the amount of refrigerant and controlling the liquefaction process, using an advanced process controller based on model predictive control to determine simultaneous control actions for a set of manipulated variables in order to optimize at least one of a set of parameters whilst controlling at least one of a set of controlled variables, wherein the set of manipulated variables includes the mass flow rate of the heavy refrigerant fraction, the mass flow rate of the light refrigerant fraction, the amount of refrigerant components make-up, the amount of refrigerant removed, the capacity of the refrigerant compressor and the mass flow rate of the methane-rich feed, wherein the set of controlled variables includes the temperature difference at the warm end of the main heat exchanger, a variable relating to the temperature of the liquefied natural gas, the composition of the refrigerant entering the separator of step (d), the pressure in the shell of the main heat exchanger, the pressure in the separator of step (d) and the level of the liquid in the separator of step (d), and wherein the set of variables to be optimized includes the production of liquefied product and wherein the controlling of the at least one of a set of controlled variables comprises controlling the pressure in the separator of step (d).

2. The process of claim 1 wherein the set of controlled variables further includes the first mid point temperature difference.

3. The process of claim 2 wherein the set of controlled variables further includes the second mid point temperature difference.

4. The process of claim 1 wherein the set of controlled variables further includes the temperature of the gas being liquefied in the first tube side at the midpoint.

5. The process of claim 2 wherein the set of controlled variables further includes the temperature of the gas being liquefied in the first tube side at the midpoint.

6. The process of claim 3 wherein the set of controlled variables further includes the temperature of the gas being liquefied in the first tube side at the midpoint.

7. The process of claim 1 wherein the variable relating to the temperature of the liquefied natural gas is the temperature of the liquefied natural gas removed from the main heat exchanger.

8. The process of claim 2 wherein the variable relating to the temperature of the liquefied natural gas is the temperature of the liquefied natural gas removed from the main heat exchanger.

9. The process of claim 4 wherein the variable relating to the temperature of the liquefied natural gas is the temperature of the liquefied natural gas removed from the main heat exchanger.

10. The process of claim 1 further comprising reducing the pressure of the liquefied stream to get the liquefied product which is passed to storage and an off-gas, and the variable relating to the temperature of the liquefied natural gas is the amount of off-gas.

11. The process of claim 2 further comprising reducing the pressure of the liquefied stream to get the liquefied product which is passed to storage and an off-gas, and the variable relating to the temperature of the liquefied natural gas is the amount of off-gas.

12. The process of claim 4 further comprising reducing the pressure of the liquefied stream to get the liquefied product which is passed to storage and an off-gas, and the variable relating to the temperature of the liquefied natural gas is the amount of off-gas.

13. The process of claim 1 wherein adjusting the amount of refrigerant comprises venting gaseous refrigerant.

14. The process of claim 2 wherein adjusting the amount of refrigerant comprises venting gaseous refrigerant.

15. The process of claim 4 wherein adjusting the amount of refrigerant comprises venting gaseous refrigerant.

16. The process of claim 1 wherein adjusting the amount of refrigerant comprises draining liquid refrigerant.

17. The process of claim 2 wherein adjusting the amount of refrigerant comprises draining liquid refrigerant.

18. The process of claim 4 wherein adjusting the amount of refrigerant comprises draining liquid refrigerant.

19. The process of claim 1 wherein the refrigerant includes nitrogen and propane, and the set of variables to be optimized further includes the nitrogen content of the refrigerant and the propane content of the refrigerant, wherein the nitrogen content is minimized and the propane content is maximized.

20. The process of claim 2 wherein the refrigerant includes nitrogen and propane, and the set of variables to be optimized further includes the nitrogen content of the refrigerant and the propane content of the refrigerant, wherein the nitrogen content is minimized and the propane content is maximized.

21. The process of claim 4 wherein the refrigerant includes nitrogen and propane, and the set of variables to be optimized further includes the nitrogen content of the refrigerant and the propane content of the refrigerant, wherein the nitrogen content is minimized and the propane content is maximized.

22. The process of claim 1 wherein the set of controlled variables further includes the power required to drive the refrigerant compressor(s).

23. The process of claim 2 wherein the set of controlled variables further includes the power required to drive the refrigerant compressor(s).

24. The process of claim 19 wherein the set of controlled variables further includes the power required to drive the refrigerant compressor(s).

25. The process of claim 1 wherein the manipulated variable capacity of the refrigerant compressor is the speed of the refrigerant compressor, the angle of the inlet guide vane of the refrigerant compressor, or both.

26. The process of claim 2 wherein the manipulated variable capacity of the refrigerant compressor is the speed of the refrigerant compressor, the angle of the inlet guide vane of the refrigerant compressor, or both.

27. The process of claim 4 wherein the manipulated variable capacity of the refrigerant compressor is the speed of the refrigerant compressor, the angle of the inlet guide vane of the refrigerant compressor, or both.

28. The process of claim 1 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

29. The process of claim 2 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

30. The process of claim 3 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

31. The process of claim 4 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

32. The process of claim 28 wherein the manipulated variable capacity of the auxiliary refrigerant compressor is the speed of the auxiliary refrigerant compressor, the angle of the inlet guide vane of the auxiliary refrigerant compressor, or both.

33. The process of claim 29 wherein the manipulated variable capacity of the auxiliary refrigerant compressor is the speed of the auxiliary refrigerant compressor, the angle of the inlet guide vane of the auxiliary refrigerant compressor, or both.

34. The process of claim 30 wherein the manipulated variable capacity of the auxiliary refrigerant compressor is the speed of the auxiliary refrigerant compressor, the angle of the inlet guide vane of the auxiliary refrigerant compressor, or both.

35. A process of liquefying a gaseous, methane-rich feed to a liquefied product, said liquefaction process comprising the steps of:

(a) providing the gaseous, methane-rich feed at elevated pressure to a first tube side of a main heat exchanger at its warm end, cooling, liquefying and sub-cooling the gaseous, methane-rich feed against evaporating refrigerant to get a liquefied steam, removing the liquefied stream from the main heat exchanger at its cold end and passing the liquefied stream to storage as liquefied product;

(b) removing evaporated refrigerant from the shell side of the main heat exchanger at its warm end;

(c) compressing in at least one refrigerant compressor the evaporated refrigerant to get high-pressure refrigerant;

(d) at least partly condensing the high-pressure refrigerant and separating in a separator the partly-condensed refrigerant into a liquid heavy refrigerant fraction and a gaseous light refrigerant fraction;

(e) sub-cooling the heavy refrigerant fraction in a second tube side of the main heat exchanger to get a sub-cooled heavy refrigerant steam, introducing the heavy refrigerant stream at reduced pressure into the shell side of the main heat exchanger at its mid-point, and allowing the heavy refrigerant stream to evaporate in the shell side; and (f) cooling, liquefying and sub-cooling at least part of the light refrigerant fraction in a third tube side of the main heat exchanger to get a sub-cooled light refrigerant stream, introducing the light refrigerant stream at reduced pressure into the shell side of the main heat exchanger at its cold end, and allowing the light refrigerant stream to evaporate in the shell side, the process further comprising adjusting the composition and the amount of refrigerant and controlling the liquefaction process, using an advanced process controller based on model predictive control to determine simultaneous control actions for a set of manipulated variables in order to optimize at least one of a set of parameters whilst controlling at least one of a set of controlled variables, wherein the set of manipulated variables includes the mass flow rate of the heavy refrigerant fraction, the mass flow rate of the light refrigerant fraction, the amount of refrigerant components make-up, the amount of refrigerant removed, the capacity of the refrigerant compressor and the mass flow rate of the methane-rich feed, wherein the set of controlled variables includes the temperature difference at the warm end of the main heat exchanger, a variable relating to the temperature of the liquefied natural gas, the composition of the refrigerant entering the separator of step (d), the pressure in the shell of the main heat exchanger, the pressure in the separator of step (d) and the level of the liquid in the separator of step (d), and wherein the set of variables to be optimized includes the production of liquefied product and wherein the controlling of the at least one of a set of controlled variables comprises controlling the pressure in the shell of the main heat exchanger.

36. The process of claim 35 wherein the set of controlled variables further includes the first mid point temperature difference.

37. The process of claim 36 wherein the set of controlled variables further includes the second mid point temperature difference.

38. The process of claim 35 wherein the set of controlled variables further includes the temperature of the gas being liquefied in the first tube side at the midpoint.

39. The process of claim 36 wherein the set of controlled variables further includes the temperature of the gas being liquefied in the first tube side at the midpoint.

40. The process of claim 37 wherein the set of controlled variables further includes the temperature of the gas being liquefied in the first tube side at the midpoint.

41. The process of claim 35 wherein the variable relating to the temperature of the liquefied natural gas is the temperature of the liquefied natural gas removed from the main heat exchanger.

42. The process of claim 36 wherein the variable relating to the temperature of the liquefied natural gas is the temperature of the liquefied natural gas removed from the main heat exchanger.

43. The process of claim 38 wherein the variable relating to the temperature of the liquefied natural gas is the temperature of the liquefied natural gas removed from the main heat exchanger.

44. The process of claim 35 further comprising reducing the pressure of the liquefied stream to get the liquefied product which is passed to storage and an off-gas, and the variable relating to the temperature of the liquefied natural gas is the amount of off-gas.

45. The process of claim 36 further comprising reducing the pressure of the liquefied stream to get the liquefied product which is passed to storage and an off-gas, and the variable relating to the temperature of the liquefied natural gas is the amount of off-gas.

46. The process of claim 38 further comprising reducing the pressure of the liquefied stream to get the liquefied product which is passed to storage and an off-gas, and the variable relating to the temperature of the liquefied natural gas is the amount of off-gas.

47. The process of claim 35 wherein adjusting the amount of refrigerant comprises venting gaseous refrigerant.

48. The process of claim 36 wherein adjusting the amount of refrigerant comprises venting gaseous refrigerant.

49. The process of claim 38 wherein adjusting the amount of refrigerant comprises venting gaseous refrigerant.

50. The process of claim 35 wherein adjusting the amount of refrigerant comprises draining liquid refrigerant.

51. The process of claim 36 wherein adjusting the amount of refrigerant comprises draining liquid refrigerant.

52. The process of claim 38 wherein adjusting the amount of refrigerant comprises draining liquid refrigerant.

53. The process of claim 35 wherein the refrigerant includes nitrogen and propane, and the set of variables to be optimized further includes the nitrogen content of the refrigerant and the propane content of the refrigerant, wherein the nitrogen content is minimized and the propane content is maximized.

54. The process of claim 36 wherein the refrigerant includes nitrogen and propane, and the set of variables to be optimized further includes the nitrogen content of the refrigerant and the propane content of the refrigerant, wherein the nitrogen content is minimized and the propane content is maximized.

55. The process of claim 38 wherein the refrigerant includes nitrogen and propane, and the set of variables to be optimized further includes the nitrogen content of the refrigerant and the propane content of the refrigerant, wherein the nitrogen content is minimized and the propane content is maximized.

56. The process of claim 35 wherein the set of controlled variables further includes the power required to drive the refrigerant compressor(s).

57. The process of claim 36 wherein the set of controlled variables further includes the power required to drive the refrigerant compressor(s).

58. The process of claim 53 wherein the set of controlled variables further includes the power required to drive the refrigerant compressor(s).

59. The process of claim 35 wherein the manipulated variable capacity of the refrigerant compressor is the speed of the refrigerant compressor, the angle of the inlet guide vane of the refrigerant compressor, or both.

60. The process of claim 36 wherein the manipulated variable capacity of the refrigerant compressor is the speed of the refrigerant compressor, the angle of the inlet guide vane of the refrigerant compressor, or both.

61. The process of claim 38 wherein the manipulated variable capacity of the refrigerant compressor is the speed of the refrigerant compressor, the angle of the inlet guide vane of the refrigerant compressor, or both.

62. The process of claim 35 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

63. The process of claim 36 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

64. The process of claim 37 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

65. The process of claim 38 wherein partly condensing the high-pressure refrigerant is done in at least one heat exchanger by means of indirect heat exchange with auxiliary refrigerant evaporating at a suitable pressure, and wherein evaporated auxiliary refrigerant is compressed in at least one auxiliary refrigerant compressor and condensed by heat exchange with an external coolant, and the set of manipulated variables further includes the capacity of the auxiliary refrigerant compressor(s), and in that the set of controlled variables further includes the power required to drive the auxiliary refrigerant compressor(s).

66. The process of claim 62 wherein the manipulated variable capacity of the auxiliary refrigerant compressor is the speed of the auxiliary refrigerant compressor, the angle of the inlet guide vane of the auxiliary refrigerant compressor, or both.

67. The process of claim 63 wherein the manipulated variable capacity of the auxiliary refrigerant compressor is the speed of the auxiliary refrigerant compressor, the angle of the inlet guide vane of the auxiliary refrigerant compressor, or both.

68. The process of claim 64 wherein the manipulated variable capacity of the auxiliary refrigerant compressor is the speed of the auxiliary refrigerant compressor, the angle of the inlet guide vane of the auxiliary refrigerant compressor, or both.

* * * * *